US009687891B2

(12) United States Patent
Frosolone

(10) Patent No.: US 9,687,891 B2
(45) Date of Patent: Jun. 27, 2017

(54) INTAKE PIPE CLEANING SYSTEM AND METHOD

(71) Applicant: Northern Divers USA, Spring Gove, IL (US)

(72) Inventor: Frank Frosolone, Spring Grove, IL (US)

(73) Assignee: Northern Divers USA, Spring Grove, IL (US)

( * ) Notice: Subject to any disclaimer, the term of this patent is extended or adjusted under 35 U.S.C. 154(b) by 21 days.

(21) Appl. No.: 14/656,139

(22) Filed: Mar. 12, 2015

(65) Prior Publication Data

US 2016/0263630 A1 Sep. 15, 2016

Related U.S. Application Data

(60) Provisional application No. 61/953,785, filed on Mar. 15, 2014.

(51) Int. Cl.

| | |
|---|---|
| ***B08B 9/00*** | (2006.01) |
| ***B08B 9/093*** | (2006.01) |
| ***B08B 7/02*** | (2006.01) |
| ***B08B 9/032*** | (2006.01) |
| ***B08B 9/057*** | (2006.01) |
| ***B24C 3/32*** | (2006.01) |
| ***B08B 3/04*** | (2006.01) |

(52) U.S. Cl.

CPC ..... *B08B 9/0321* (2013.01); *B08B 3/04* (2013.01); *B08B 9/0325* (2013.01); *B08B 9/057* (2013.01); *B24C 3/327* (2013.01)

(58) Field of Classification Search

CPC ..... B08B 9/032; B08B 9/0321; B08B 9/0328; B08B 9/027; B08B 9/0433; B08B 9/051; B05D 7/222; B24C 1/003; E03B 7/006

USPC ..... 134/6, 8, 17, 22.1, 22.11, 22.12, 22.18, 134/24; 451/76, 60, 91

See application file for complete search history.

(56) References Cited

U.S. PATENT DOCUMENTS

| | | | | |
|---|---|---|---|---|
| 3,139,704 A | | 7/1964 | McCune | |
| 3,667,487 A | * | 6/1972 | Schoenbeck | B08B 9/0321 134/108 |
| 4,921,546 A | * | 5/1990 | Bloch | B08B 9/0325 134/22.12 |

(Continued)

OTHER PUBLICATIONS

United States Patent and Trademark Office, International Search Report in International Patent Application No. PCT/US2015/020102 (Jun. 19, 2015).

*Primary Examiner* — Nadine Norton
*Assistant Examiner* — Christopher Remavege
(74) *Attorney, Agent, or Firm* — Leydig, Voit & Mayer, Ltd.

(57) ABSTRACT

A system and method for pipe cleaning are disclosed, which include arranging at least one pump to draw a flow of water from the body of water. An output of the at least one pump is fluidly connected to the pipe through a junction disposed between the one end of the pipe and the free end of the pipe, and the at least one pump is activated to draw the flow of water and provide the flow of water to the pipe through the junction such that a flow of water passes through the pipe to remove the debris. The debris is thus entrained in the flow of water and ejected from the pipe through the free end into the body of water until the pipe is clean.

17 Claims, 4 Drawing Sheets

(56) References Cited

U.S. PATENT DOCUMENTS

| | | | | |
|---|---|---|---|---|
| 5,069,722 | A * | 12/1991 | Murphy | B08B 9/0436 134/22.11 |
| 5,421,904 | A | 6/1995 | Carlson | |
| 5,558,108 | A * | 9/1996 | Croswell, Sr. | B08B 9/0321 134/22.12 |
| 5,680,877 | A * | 10/1997 | Edstrand | B08B 9/032 134/103.1 |
| 6,363,566 | B1 | 4/2002 | Collins | |
| 6,394,112 | B1 | 5/2002 | Steinmetz et al. | |
| 6,458,214 | B1 * | 10/2002 | Kanda | B08B 9/0321 134/21 |
| 7,306,001 | B1 * | 12/2007 | Garcia, Jr. | B08B 9/0321 134/167 C |
| 8,104,496 | B1 * | 1/2012 | Washington | E03B 7/006 137/15.04 |
| 2004/0129293 | A1 * | 7/2004 | Eichenberger | B08B 7/02 134/1 |
| 2006/0125172 | A1 | 6/2006 | Hashimoto et al. | |
| 2011/0031195 | A1 * | 2/2011 | Wilkinson | B08B 9/0321 210/790 |

* cited by examiner

INTAKE PIPE CLEANING SYSTEM AND METHOD

CROSS REFERENCE TO RELATED APPLICATIONS

This patent application claims the benefit of U.S. Provisional Patent Application No. 61/953,785, filed on Mar. 15, 2014, and titled "Fresh Water Intake Cleaning Method and System," which is hereby incorporated herein in its entirety by this reference.

TECHNICAL FIELD

This patent disclosure relates generally to water intake systems and, more particularly to cleaning methods and structures for water intake pipes.

BACKGROUND

Industrial, municipal and other large-scale water supply systems are known and used to provide potable and other types of water to cities, compounds, industrial processes and the like. In such systems, water may be drawn from a reservoir such as a lake, aquifer and others, for distribution to consumers. Drawn water is usually filtered and purified using various processes such as filtration, sedimentation, disinfection, desalination, as appropriate, and the like before being pressurized for storage and distribution. In certain applications such as for municipal water supplies where the water delivered to consumers is potable, additional treatments may be used such as chlorination, fluoridation, and others. One method to store useable, purified water is by use of elevated tanks. Distribution of purified water to and from the elevated tanks is carried out through a closed network of pipes and other fluid conduits to the consumers.

To draw the water for treatment from a reservoir, such as from a lake, a water treatment facility will typically use a pipe made from concrete, steel or ductile iron, that extends to a predetermined distance and depth into the lake from the shore. Pumps are used to pull or push lake water into the intake pipe, which is thus provided to a treatment facility for treatment and distribution as described above. Over time, dirt, debris, plant and animal material may collect within and around the exterior of the intake pipe. While material collected on a pipe exterior may not affect the water being carried thereby, collection of foreign matter within the pipe may affect the quality and quantity of water collected for treatment.

One measure of un-processed water quality that can be used to assess the quality of a water supply is turbidity. Turbidity is a quantifiable measure of the cloudiness or haziness of a fluid caused by particles that can be suspended or dissolved in the fluid. While such particles may be generally invisible to the naked eye, in severe turbidity conditions, they may be visible to the naked eye and render the fluid cloudy. The measurement of turbidity is a key test of quality for water provided to a water treatment facility because increased turbidity requires additional filtration, sedimentation and other treatment processes to be used, which can significantly increase the cost to build and maintain a water treatment facility.

One challenge often encountered by water treatment entities, especially when above-ground water reservoirs are used to collect water for treatment, is that contamination of water intake pipes with foreign matter will tend to, over time, increase the turbidity of the water made available to the treatment plant. Because of regulated and environmental factors dictating strict standards for treated water supplies, an increase in water turbidity is an issue that is closely monitored and addressed. As can be imagined, to rectify an increase in turbidity in water supplied to treatment plants due to collection of foreign matter within the intake pipe requires a cleaning of the intake pipe. Presently known and used methods to clean such intake pipes can be quite complicated, expensive and/or not environmentally friendly, and can include cleaning processes, in which human divers or submersible devices traverse the internal portion of intake pipes to perform rigorous cleaning operation, the laying of new pipes to replace the old, soiled pipes. Additionally, known techniques for cleaning pipes having sensitive structures disposed therein, such as chlorine or bromine dispensers for municipal water plants, require that those structures be removed before a cleaning operation, which can cost hundreds of thousands of dollars. Other methods for pipe cleaning include sending shuttles, so called "pigs," through the pipes to clean them, which requires that sensitive structures be removed from within the pipe. However, all these known methods are costly and can become complicated. Moreover, certain pipe systems, which may include sensors and other devices within the pipe, can only be cleaned by manual or chemical operations to avoid damaging any devices present in the pipe.

SUMMARY

The present disclosure seeks to address the issues and shortcomings of known intake pipe cleaning processes by implementing an expedient, simple and cost effective way of removing debris from intake pipe systems. In one disclosed embodiment, the cleaning methods and systems described herein involve the use of pumps and air compressors to create a turbulent water flow through a pipe of any diameter and of any length. The cleaning flow is provided in an opposite flow direction to the normal intake flow direction of the pipe. The disclosed process creates a fluid structure within the pipe, for example, a vortex, which increases water flow and momentum within the pipe and close to the pipe walls where most debris is typically found. The water flow disturbance, which may be augmented by the introduction of solids such as ice, loosens and removes debris from the pipe walls.

Material that is removed from a piping system in accordance with the present disclosure can include zebra mussels, sand, silt and, in general, other types of natural or man-made debris. The debris thus removed may be collected and removed, for example, by screening, or, if possible, may be simply returned to the open body of water from which it came.

In one embodiment, the flow of water provided to the intake pipe for cleaning can be combined with solids, such as ice, or air, to enhance the cleaning effect. The combination of air and water, forced through a specially constructed manifold under high pressure, creates a flow structure such as a vortex that provides a scrubbing effect onto the internal walls of pipes made from any commonly used material such as concrete, steel or ductile iron. The scrubbing action contemplated by the present disclosure advantageously works without damaging interior pipe walls or secondary piping such as suction lines or chlorine lines can typically be found on the interior pipe walls.

In one method disclosed herein, a process for cleaning water intakes includes using a variety of water pumps and air compressors to create a turbulent water flow through a pipe of any diameter and of any length. The process creates a vortex which loosens and removes any debris from the piping system. The materials removed include but are not limited to zebra mussels, sand, silt and all sorts of natural and man-made debris. The removal of said debris can be contained or distributed into open water. The containment method is a separate proven method, such as, silt screening.

The combination of air and water, forced through a custom made manifold under high pressure, creates a vortex that acts as a scrubbing vehicle on concrete, steel or ductile iron pipe. This scrubbing action works without damaging any interior pipe walls or secondary piping, such as suction lines or chlorine lines that are often installed on the interior pipe walls. This process can be completed with water only, with water and air, and/or with water and solids such as ice. In certain conditions, the material being removed from the pipe, for example sand, may help clean the pipe as it moves through the pipe under a turbulent motion of the water flowing backwards through the pipe during cleaning.

This process has already been successfully demonstrated for a water intake structure at a large municipality near Chicago, Ill. The before and after documentation on turbidity and chemical cost savings, related to this project, show an improvement in turbidity of up to 99% (60-300 ppm of solids before cleaning, about 003 ppm of solids after cleaning).

During cleaning, the cleaning flow of water is selected to be about 3 to 4 times the normal flow rate of water through the pipe. For example, an intake pipe used to provide about 10M gallons per day may be cleaned by pushing 30M gallons of water per day in the opposite direction of normal flow for about a week or until the pipe is clean. Adjustments to the flow rate of water through the pipe, duration of pipe cleaning, addition of air and/or solids in the cleaning flow, may be adjusted during this process depending on the type of debris found in the pipe, the extent of debris accumulation, and other factors.

Therefore, in one aspect, the disclosure describes a method for removing debris from an interior of a pipe that has collected over time. The method includes fluidly isolating one end of a pipe and maintaining a second, free end of the pipe, in fluid communication with a body of water. At least one pump is arranged to draw a flow of water from the body of water. An output of the at least one pump is fluidly connected to the pipe through a junction disposed between the one end of the pipe and the free end of the pipe, and the at least one pump is activated to draw the flow of water and provide the flow of water to the pipe through the junction such that a flow of water passes through the pipe to remove the debris. The debris is thus entrained in the flow of water and ejected from the pipe through the free end into the body of water until the pipe is clean.

In another aspect, the disclosure describes a method for reducing turbidity by at least 99% in a water flow drawn through a water intake pipe having a free end thereof submerged within a body of water. The method includes fluidly isolating one end of a pipe opposite the free end, arranging a pump to draw a flow of water from the body of water and provide a cleaning flow of water at a pump output, and fluidly connecting the pump output with a junction of the pipe, the junction disposed between the one end and the free end such that the cleaning flow of water passes through the pipe in a direction opposite the water flow drawn through the free end during normal operation of the pipe. The method further includes inducing a swirl around a flow axis of the cleaning flow of water as the cleaning flow of water travels along the pipe, using the cleaning flow of water to dislodge debris from an interior of the pipe, and also to entrain said debris into the cleaning flow of water, and ejecting the cleaning flow of water from the free end of the pipe such that the debris entrained within the cleaning flow of water returns to the body of water from which it entered the pipe through the free end over time.

In yet another aspect, the disclosure describes a system for cleaning an intake pipe having a free end submerged in a body of water and a closed end from which is water is drawn into and through the pipe during operation. The intake pipe having an opposite end from which water may be provided to a process. The system includes at plurality of pumps, each having an inlet and an outlet, the inlet disposed to draw a respective cleaning flow of water from the body of water, and a cleaning manifold disposed in fluid communication between each of the outlets of the pump and a junction disposed along, and in fluid communication with, the intake pipe between the free end and the opposite end such that an intake pipe segment is defined between the free end and the junction. In one embodiment, when the plurality of pumps is operating, the respective cleaning flows of water from the plurality of pumps are aggregated in the cleaning manifold, and the cleaning manifold is configured to impart a swirl in the aggregated cleaning flows, and provide the swirling, aggregated cleaning flows into and through the pipe segment, such that the swirling, aggregated cleaning flows pass through the pipe segment, dislodge and entrain therein debris present in the pipe segment, and are ejected along with the debris from the pipe segment through the free end and into the body of water.

DETAILED DESCRIPTION

This disclosure relates to systems and methods for cleaning fluid pipes and, more particularly, to systems and methods for removing debris from an intake pipe that is disposed to provide access to water from a body of water to a facility. The facility may be any type of facility that draws fresh or saline water for any reason. For example, the facility may be a municipal facility drawing water from a lake to process into potable water, or may alternatively be a facility using water for cooling or steam generation, such as a power plant, or for washing, such as a chemical plant.

Figure 1:
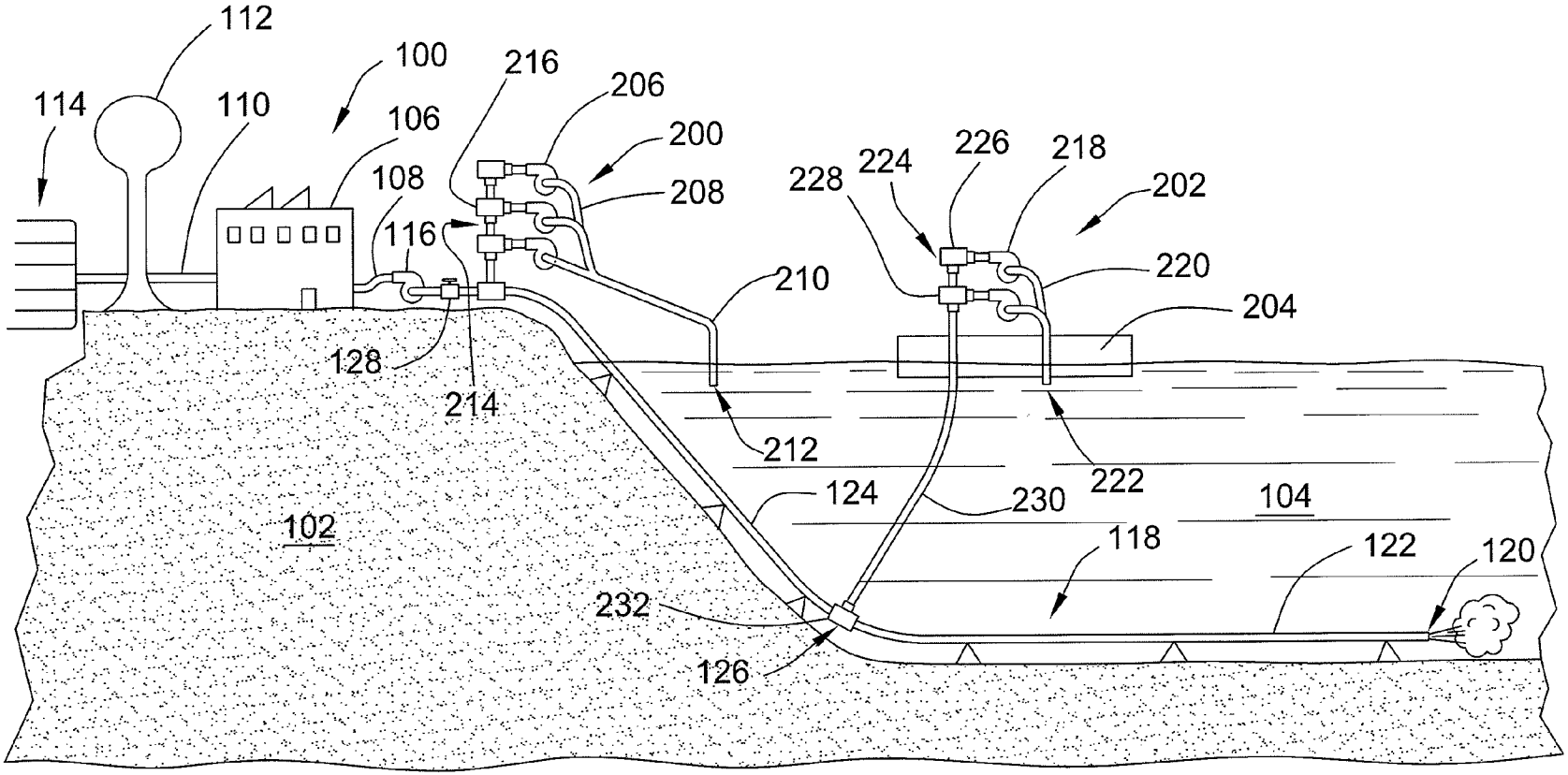
FIG. 1 is a schematic representation of an exemplary water treatment facility that is configured for a cleaning operation in accordance with the disclosure.

An exemplary embodiment for a facility 100 is shown in FIG. 1. The facility 100 is located on a shore 102 that is adjacent to a water body 104, in this case, a lake, but any other body or stream of water can be used. The facility 100 is illustrated as an exemplary embodiment only and should not be construed as limiting to the scope of the disclosure. As shown, the facility 100 includes a plant 106 that takes in water via a feed conduit 108. In the exemplary embodiment shown, the facility 100 is a municipal water treatment plant that processes the water into potable water and provides it to an outlet conduit 110. From the outlet conduit, the water is stored in a tower 112 and distributed through a network 114 to a city.

In the embodiment shown, a feed pump 116 is connected between the feed conduit 108 and an intake pipe 118. The intake pipe 118 extends into the water body 104 and has a free end 120 submerged in the water body 104 such that the feed pump 116 is disposed in fluid communication with the water body 104 and can draw water therefrom. During operation of the plant 106, the feed pump 116 operates to provide water to the plant 106 by pulling water into the free end 120 such that the water passes through the intake pipe 118 and reaches the feed pump 116, which then provides it to the plant 106 through the feed conduit 108.

In the illustrated embodiment, the intake pipe 118 includes a first section 122, and a second section 124. The two sections meet at an elbow or transition 126. In the illustrated embodiment, the first section 122 is generally horizontal, and the second section 124 is generally inclined for illustration only and to show that certain sections of the intake pipe may be more prone to accumulating deposits and debris than others, but it should be appreciated the inclination is not the only parameter that can affect the formation of deposits. Other parameters include water temperature along an intake pipe, distance from the free end 120, water velocity through the various sections during operation, and other factors. In the illustrated embodiment, for the sake of discussion, two different embodiments of cleaning systems are discussed to show different implementation methodologies. Accordingly, a first cleaning system 200 is shown installed on shore 102 close to the plant 106, and a second cleaning system 202 is shown installed on a barge 204 off the coast, for illustration. Although these systems can be used together, one or the other would typically be used at any one time, and are shown together in FIG. 1 for illustration and for the sake of discussion.

Accordingly, the first cleaning system 200 is useful for cleaning the intake pipe 118. The first cleaning system 200 is connected to the intake pipe 118 at a location generally close to the feed pump 116. A shutoff valve 128 fluidly isolates the feed pump 116 and plant 106 from water flow and, possibly, debris, that may be agitated in the intake pipe 118 during a cleaning operation and while the first cleaning system 200 is operating. It should be mentioned that the cleaning operation, which induces a cleaning flow of water to pass through the intake pipe 118, does so in a reverse or forward direction with respect to the normal flow of water through the pipe.

The first cleaning system 200 essentially includes one or more pumps 206, each connected to a supply pipe 208. The supply pipe(s) 208 may, together or separately, draw water from the water body 104 through an inlet 212. As shown, the inlet 212 is formed at an end of a combined inlet pipe 210 that feeds water to each of the pump(s) 206. It is noted that the pumps 206 may have different sizes and capacities depending on the particular cleaning arrangement that is implemented for the intake pipe 118. The pumps 206 discharge water into a cleaning manifold 214, which feeds the combined output of the pumps 206 into the intake pipe 118. The cleaning manifold 214 may comprise various pipe segments 216 arranged to collect and direct water from the pumps 206 into the intake pipe 118. As can be appreciated, the flow from the cleaning manifold 214 will flow in a reverse direction relative to the normal flow of the intake pipe, but a forward flow arrangement can also be used, for example, by feeding the cleaning flow through the free end and releasing debris through the junction, which can be opened to the body of water.

Specifically, where the intake pipe 118 draws water in from the free end 120 during normal operation, during a cleaning process, water is drawn into the cleaning system 200 through the inlet 212 and passes through the intake pipe 118 in a direction that is opposite to normal operation. Accordingly, water enters the system through the inlet 212, is pressurized at the pumps 206, collects in the cleaning manifold 214, where a swirl, turbulence and/or cleaning agents are added, and then passes into the intake pipe 118 and traverses the intake pipe 118 to be released or to exit through the free end 120 back into the water body 104. In this way, debris and other material collected into the intake pipe 118 during normal use over time is agitated, freed from the pipe, and deposited back into the water body 104 from which it came. To illustrate, organic and inorganic deposits present in the intake pipe 118 that collect over the period of a year or more can be injected back into the water body 104 during a cleaning process that can last about one week or more. The cleanings can be periodic, e.g., yearly, or on an as-needed basis. Further, certain components of the cleaning system 200, for example, certain components of the cleaning manifold 214, may be permanently left on the site or assembled for each cleaning process, and then disassembled and removed or stored close to the plant 106.

Regarding the second cleaning system 202, it can be seen that a plurality of pumps 218 draws water from the water body 104 via an inlet conduit 220 that is open to the water via a feed opening 222. As shown, two pumps 218 are used, but any number of pumps can be used. The pumps 218 feed a manifold 224, which in this case includes an elbow 226 and a junction 228, which can be a T-junction, Y-junction, or any other type of junction. The manifold 224 feeds water from the pumps 218 to a pipe 230 that is connected to the intake pipe 118 at a junction 232. In the illustrated embodiment, the junction 232 coincides with the transition 126 separating the two portions, the first section 122 and the second section 124 of the pipe, but it can be placed anywhere along the intake pipe 118. Also, more than one transition may be present. During a cleaning cycle, and while the valve 128 is closed, the second cleaning system 202 forces water to flow through a portion of the intake pipe between the junction 232 and the free end 120 in a direction that is opposite the flow of water during normal operation.

Figure 2:
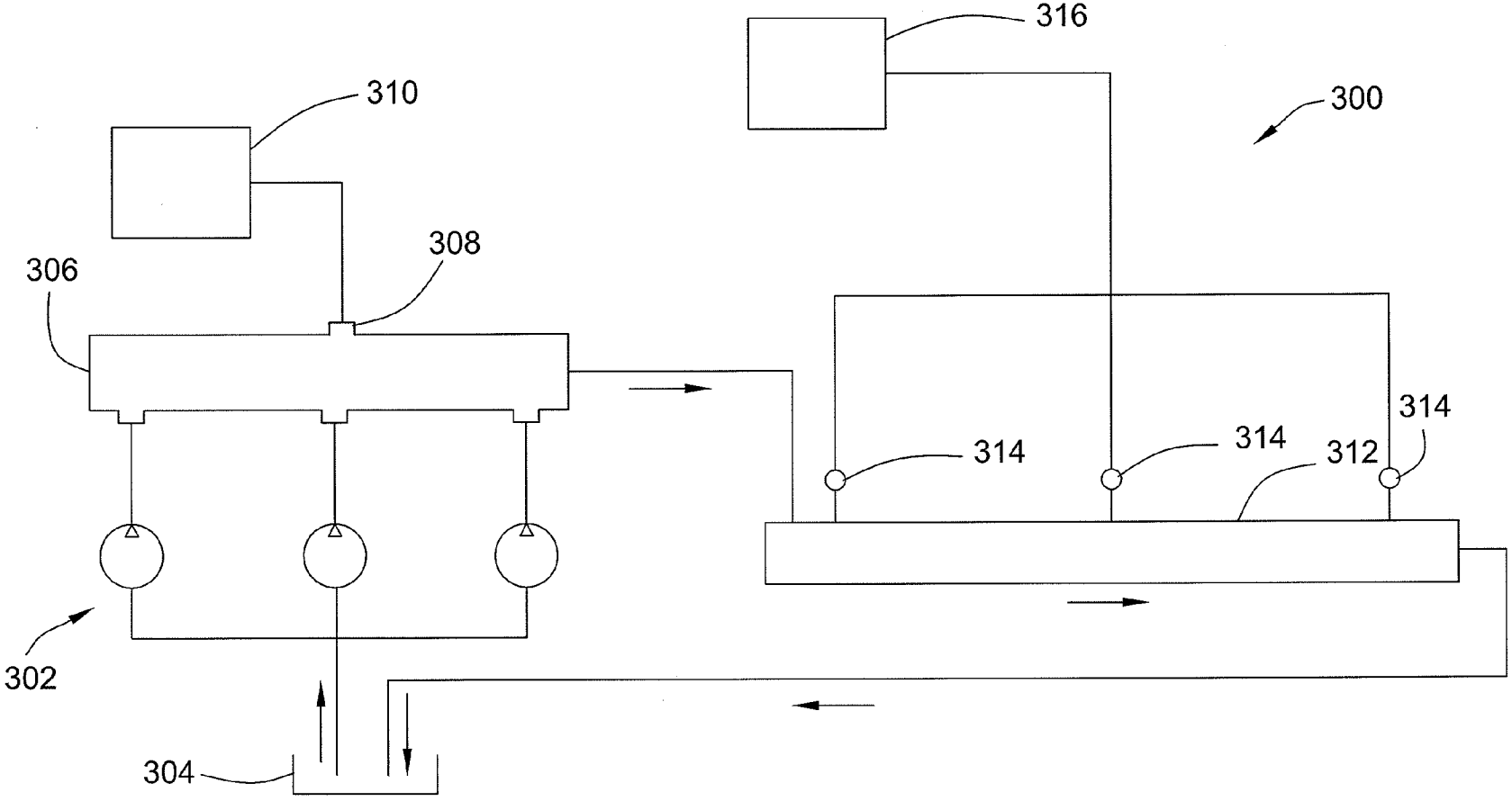
FIG. 2 is a schematic view of a cleaning system for an intake pipe in accordance with the disclosure.

A schematic or block diagram of a cleaning system 300 in accordance with the disclosure is shown in FIG. 2. The cleaning system 300, as previously described, includes a plurality of pumps 302, but it should be appreciated that a single pump can also be used. The pumps 302 draw water from a reservoir 304, which in a real-world application can be any body of water such as a lake, ocean, river, and others. An output of the pumps 302 is collected in a cleaning manifold or, as shown here, a collection manifold 306. An optional injector 308 is connected along the collection manifold 306 and configured to inject in the combined water flow therein cleaning agents such as air bubbles, sand, ice chunks, and other abrasives that are entrained in the water flow and carried through the cleaning process. Such materials are provided by a source 310. The source 310 may be a compressed air tank, ice dispenser, or the like, or may alternatively be a hopper full of sand or other material taken from around the water body or reservoir 304, and is return thereto during the cleaning process.

The aggregate cleaning flow created within the collection manifold 306 is provided to an intake pipe 312 in a flow direction that is opposite the flow direction of water in the intake pipe during normal operation. It is noted, however, that, depending on the system arrangement, water flow may be provided in the normal flow direction through the intake pipe. Water from the intake pipe 312 is returned to the reservoir 304. Optional sensors 314 disposed along the intake pipe 312 can provide information to a monitor 316 relative to the cleaning process, for example, turbidity, opaqueness, etc. along the length of the pipe such that the cleaning process can be monitored. The monitor 316 may be a visual interface for a user, or may alternatively be a programmable logic controller that can automatically adjust cleaning parameters based on feedback from the sensors 314. Such cleaning parameters can include pump flow rate, the amount and type of cleaning additives from the source 310, and the like.

Figure 3:
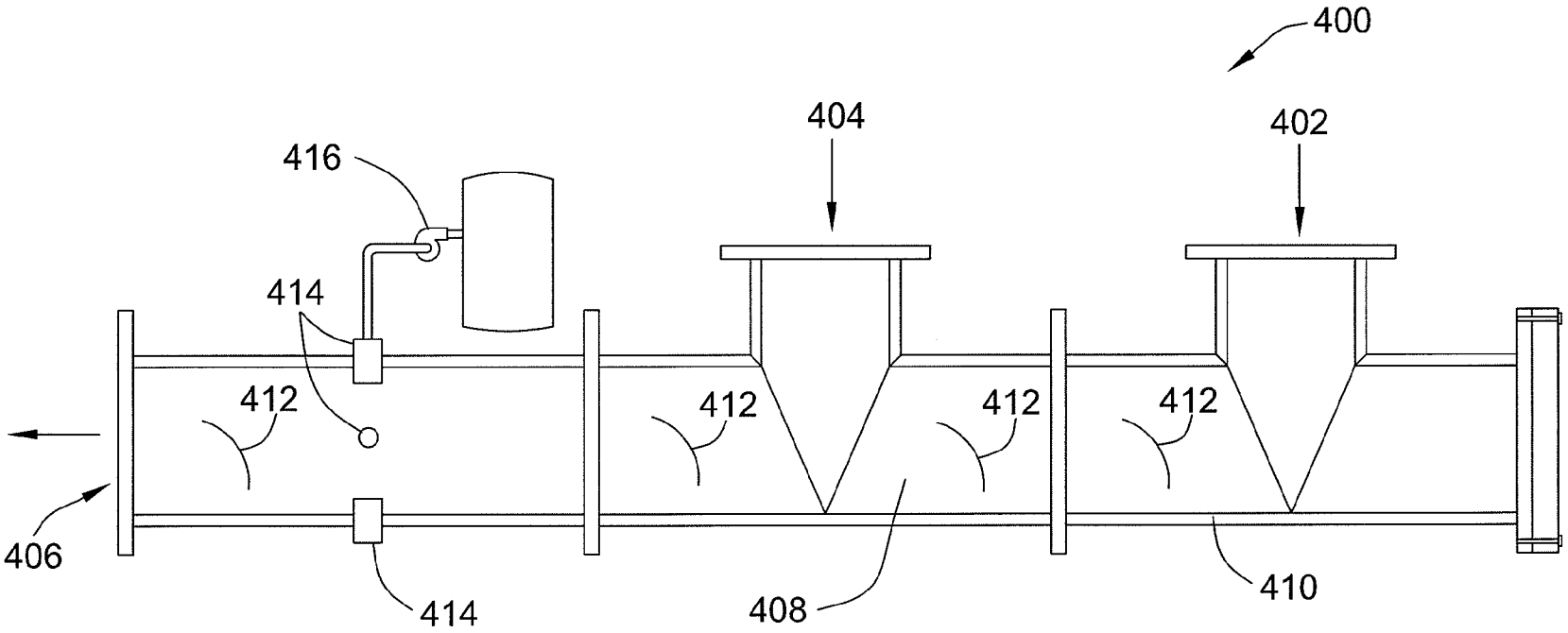
FIG. 3 illustrates one embodiment for a cleaning system manifold in accordance with the disclosure.

A section view through one embodiment for a cleaning manifold 400 is shown in FIG. 3. In this embodiment, the cleaning manifold 400 includes a first inlet 402 and a second inlet 404, each of which is arranged to connect to a corresponding pump (not shown), and an outlet 406, which is connectable to an intake pipe to be cleaned (not shown), for example, the intake pipe 118 (FIG. 1). The cleaning manifold 400 forms an internal cavity 408 surrounded by a wall 410 having a generally cylindrical shape. Optional fins 412, each having a curved shape, are disposed along the wall 410 at predetermined locations such that water flowing into the internal cavity 408 assumes a turbulent or swirling flow characteristic, which it carries with it into the intake pipe to be cleaned, which enhances a cleaning effect.

In the illustrated embodiment, a plurality of air injectors 414 are disposed around a section of the wall 410. The air injectors 414 are connected to a pressurized air tank via a flow meter or regulator 416 such that, during operation, metered amounts of air at a controlled pressure is provided in a water flow passing through the internal cavity 408 to enhance the cleaning process. It is noted that the size of bubbles formed in the water flow passing through the internal cavity 408 can be adjusted based on the pressure of the air, number and size of air injectors 414, as well as a shape and configuration of air nozzles associated with each of the air injectors 414.

Figure 4:
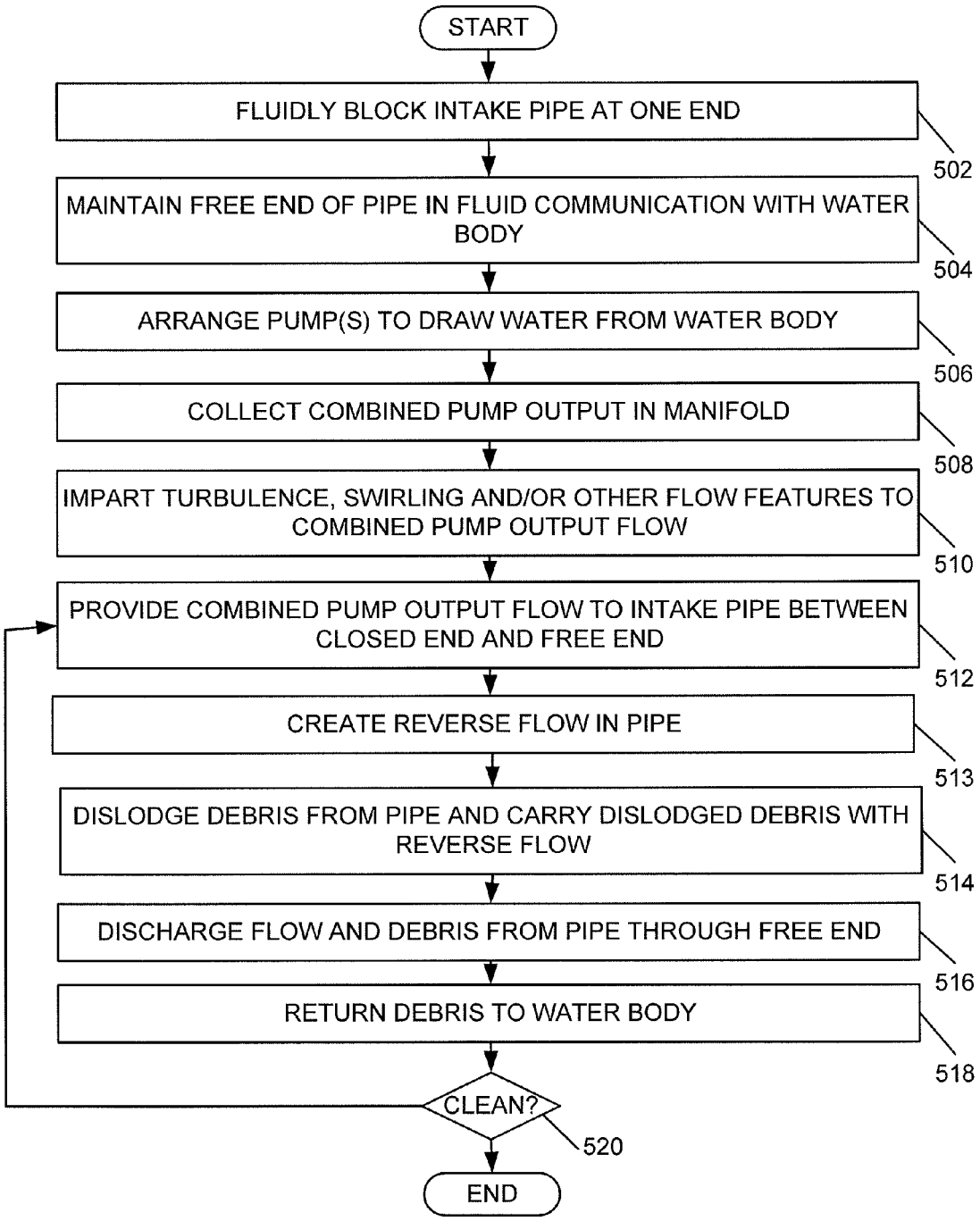
FIG. 4 is a flowchart for a method of cleaning an intake pipe in accordance with the disclosure.

A flowchart for a method of cleaning an intake pipe is shown in FIG. 4. In accordance with the method, the intake pipe is fluidly isolated and blocked at one end at 502. A second, free end of the pipe is maintained in fluid communication with a water body at 504. One or more pumps are arranged to draw water from the water body at 506. A combined pump output is collected in a manifold at 508. Turbulence, swirling and other flow features are imparted to the combined pump output at 510. Optionally, additional cleaning agents and/or abrasives are added to the combined pump output flow.

The combined pump output is provided into the intake pipe between the closed end and the free end at 512, such that a reverse flow is created in the intake pipe at 513. The reverse flow is a flow of water through the pipe that is in an opposite direction relative to a flow through the pipe during normal operation. In an alternative embodiment, flow if the forward direction can be used instead of the reverse direction. The swirling flow passes through at least a portion of the intake pipe, where the swirling mass of water dislodges and carries with it debris present in the pipe at 514. The swirling flow, along with the debris entrained therein, exits the intake pipe through the free end at 516, and thus returns the debris to the water body at 518. Because any debris from within the pipe is returned to the water body from which it came, no additional filtering or collection of debris is necessary for most cleaning operations, although it should be noted that local rules and regulations must always be followed. This cleaning process is maintained at 520 while the pipe requires further cleaning.

To illustrate certain cleaning parameters that have been employed in the past to clean intake pipes, with unexpected and surprising positive results, the following examples are discussed. In a first exemplary cleaning operation, the flow induced through the pipe to be cleaned is arranged to be between 3 or 4 times the normal flow that the intake pipe handles. Such flow can thus be selected depending on application. In previous applications, flows between 10 and 30 million gallons per day have been used, but flows up to 500 million gallons per day (about 20 million gallons per hour) can be used. To select a proper additive to the water, which is optional, air was used to introduce bubbles in the flow, which act to help dislodge debris stuck to the inside surfaces of the pipe.

The various sensors that can be used to monitor the cleaning operation can include turbidity meters, flow and other meters, as well as visual sensors such as cameras. A typical cleaning operation can last about a week, or can be carried out until a pipe is sufficiently clean. From a hardware standpoint, the manifold is typically a manifold that was designed specifically for each application. For most applications, depending on the nominal size or diameter of the intake pipe, the manifold may have a nominal diameter of between 24 to 48 inches, and create turbulence that carries through the intake pipe to be cleaned, but manifolds having diameters as large as 120" can be used, all depending on the size of pipe to be cleaned and the water flow that will be used to clean it.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A method for removing debris from an interior of a water intake pipe that has collected over time, a substantial portion of the water intake pipe being submerged in a body of water and lying on the bottom of the body of water, the method comprising:

fluidly isolating one end of the water intake pipe that is disposed opposite an inlet end of the water intake pipe;

maintaining the inlet end the water intake pipe in fluid communication with the body of water and in place adjacent the bottom of the body of water such that a substantial portion of the water intake pipe remains submerged and full of water from the body of water;

arranging at least one pump to draw a flow of liquid water directly from the body of water;

fluidly connecting an output of the at least one pump to the one end of the water intake pipe through a junction disposed between the one end of the water intake pipe and the inlet end of the water intake pipe;

activating the at least one pump to draw the flow of liquid water directly from the body of water;

providing the flow of liquid water to the water intake pipe through the junction such that a flow of liquid water passes through the water intake pipe to create a continuous water circuit for the liquid water flow that extends from the pump, through the junction, into the one end of the water intake pipe, through the substantial portion of the water intake pipe that is disposed along the bottom of the body of water, through the inlet end of the water intake pipe, and into the body of water to remove the debris, which is ejected from the water intake pipe through the end into the body of water until the water intake pipe is clean; and maintain the pump active to provide the liquid flow of water through the water intake pipe until the water intake pipe is clean, wherein the liquid flow of water provided through the water intake pipe for cleaning is higher than a normal flow of liquid water through the water intake pipe during normal operation.

2. The method of claim 1, wherein, during normal operation, the water intake pipe draws water from the body of water through the inlet end, and provides the drawn water to an additional pump disposed in fluid communication with the one end of the water intake pipe.

3. The method of claim 2, wherein the flow of water during cleaning is in a reverse direction relative to a water flow direction during service.

4. The method of claim 2, wherein the water drawn into the pipe carries with it the debris that collects on internal walls of the pipe over time.

5. The method of claim 1, further comprising:

arranging a second pump to draw a second flow of liquid water from the body of water;

providing the second flow of liquid water to an output of the second pump; and combining the flow of liquid water from the pump with the second flow of liquid water from the second pump in a manifold;

wherein the manifold is fluidly disposed between the pump, the second pump, and the junction such that the pump and the second pump are disposed in parallel circuit connection along the continuous water circuit.

6. The method of claim 1, further comprising mixing a cleaning agent with the flow of water such that the cleaning agent is entrained in the flow of water as it passes through the water intake pipe.

7. The method of claim 6, wherein the cleaning agent operates to facilitate dislodgement of the debris from the interior of the water intake pipe.

8. The method of claim 6, wherein the cleaning agent includes at least one of ice particles, air bubbles, and sand.

9. The method of claim 1, further comprising imparting a swirl in the flow of water as it passes through the water intake pipe to enhance debris removal.

10. The method of claim 9, wherein imparting the swirl is accomplished by shaping the flow of water as it passes through a fluid conduit.

11. The method of claim 10, wherein the shaping includes providing shaped fins in the fluid conduit.

12. The method of claim 1, further comprising:

monitoring one or more parameters indicative of a progress of a water intake pipe cleaning process, and adjusting one or more cleaning parameters during the water intake pipe cleaning process based on the parameters monitored.

13. The method of claim 12, wherein the one or more cleaning parameters monitored include turbidity, flow speed, and visual information.

14. The method of claim 1, wherein the water intake pipe is clean when a turbidity in the water intake pipe is reduced by 99%.

15. The method of claim 1, wherein the flow of water is between 3 to 4 times a flow of water that is drawn through the water intake pipe during normal operation.

16. The method of claim 1, wherein the junction is disposed close to the one end of the water intake pipe.

17. The method of claim 1, wherein the junction is disposed adjacent a water intake pipe segment that is more prone to collect debris than another water intake pipe segment.

* * * * *